United States Patent [19]

Share et al.

[11] Patent Number: 4,790,387

[45] Date of Patent: Dec. 13, 1988

[54] WELLPOINT ASSEMBLY AND METHOD OF INSTALLING A WELLPOINT ASSEMBLY

[76] Inventors: Jack H. Share, P.O. Box 250 N. Halifax Dr.; Stanley Share, P.O. Box 211 Ellicott Dr., both of Ormond Beach, Fla. 32074

[21] Appl. No.: 592,534

[22] Filed: Mar. 26, 1984

[51] Int. Cl.[4] ..... E21B 43/00; E21F 16/00

[52] U.S. Cl. ..... 166/379; 137/355.26; 166/52; 248/87; 405/36

[58] Field of Search ..... 166/52, 75 R, 207, 378, 166/379, 380; 137/355.26; 405/36, 51; 248/71, 49, 65, 87, 88

[56] References Cited

U.S. PATENT DOCUMENTS

| | | | |
|---|---|---|---|
| 218,875 | 8/1879 | Green | 166/52 |
| 3,566,982 | 3/1971 | Share et al. | 166/52 |
| 3,684,224 | 8/1972 | Kwako | 248/87 |
| 3,774,630 | 11/1973 | Prange | 137/355.26 |
| 4,260,283 | 4/1981 | Croy | 405/36 |

FOREIGN PATENT DOCUMENTS

| | | | |
|---|---|---|---|
| 166272 | 2/1955 | Austria | 405/36 |

*Primary Examiner*—Hoang C. Dang

*Attorney, Agent, or Firm*—William M. Hobby, III

[57] ABSTRACT

A wellpoint assembly includes an elongated flexible header pipe which has a plurality of coupling joints formed therein for attaching well point assemblies. The flexible header pipe is stored on a reel so that it can be unreeled into a predetermined pattern for installing in a wellpoint system. An alignment tool allows the flexible header pipe to be aligned for attaching each wellpoint assembly. The flexible header pipe may be transparent and have saddle coupling joints which will accept either a saddle plug or a wellpoint assembly connection. A method of installing a well point system includes the steps of pulling a flexible header pipe from a reel; laying the flexible header pipe in a pattern for installing a wellpoint system; aligning the flexible header pipe for attaching wellpoint systems; removing the coupling plugs from wellpoint coupling members in the flexible header pipe; and attaching wellpoint assembly pipes.

15 Claims, 2 Drawing Sheets

WELLPOINT ASSEMBLY AND METHOD OF INSTALLING A WELLPOINT ASSEMBLY

BACKGROUND OF THE INVENTION

The present invention relates to wellpoint assemblies and to a method of installing wellpoint assemblies and especially to a system using flexible header pipes which can be unreeled into any desired pattern, aligned and connected to well point assemblies.

It is necessary to dewater a construction area when construction work is being done below the ground surface in order to remove all water and other liquids from an excavation area to provide dry working conditions. The most common technique of dewatering an excavation area is to sink a plurality of well points around the area and connect a pump to each of the well points so that the water will be pumped from the area surrounding the excavation. In a typical wellpoint system, a series of rigid header pipe, such as PVC plastic pipe, is laid around the excavation site and the pipes installed together through clamp-type pipe couplings. The rigid header pipe has holes drilled therein and a coupling attached to the holes in the header pipe so that a wellpoint assembly can be attached to the rigid header pipe. The wellpoint assembly may include a short smaller pipe having a coupling thereto for coupling to the rigid header pipe and to the top of one of the wellpoint well heads. The entire wellpoint system is attached to a dewatering pump to remove water from each of the wellpoint assemblies into the rigid header pipe to maintain the excavation area dry. This type of wellpoint system has worked satisfactory for many years but requires the use of large amounts of rigid pipe which typically may be 20 feet long and various types of coupling mechanisms for coupling the pipe together. When using a typical rigid header pipe system that is to conform with the shape of the excavated area, it is necessary to use various fittings, ells, tees, couplings, clamps and multiple lengths of pipe to custom assemble the header line. Each well point installation is essentially a ring system and the cost of installing and removing the rigid pipe is further complicated by the removal of the system which frequently has little salvage value, except for the pump, for any other well point installation.

The present invention deals with a flexible header pipe which is formed of one continuous piece in any length desired and has couplings already formed therein at spaced points along the flexible header pipe for attaching well point assemblies. The flexible header pipe can be stored and removed from a large reel and shaped to form a wellpoint layout of any desired pattern for attaching the wellpoint assemblies. The header pipe can be easily disconnected and moved without being disassembled. This is especially productive in progressive wellpointing for long utility sewer and force main lines where 50 feet to 100 feet of flexible header can be moved on the ground by hand or mechanical means to its next location without being disassembled and loaded onto a vehicle and then reassembled again for installation. Means must be provided to align the flexible pipe for attaching the wellpoint assembly connecting line which is typically connected to the top of the flexible header. The flexible header might be located in a wide variety of positions as the pipe is laid out into a pattern around an excavation site.

There have been any number of prior wellpoint systems but one system can be seen in our prior U.S. Pat. No. 3,566,982 dated Mar. 2, 1971 for a wellpoint system. Another typical system can be seen in U.S. Pat. No. 4,020,902 and in U.S. Pat. No. 3,995,690 for wellpoint system and in the various references cited in these patents. The aim of the present invention is to overcome the difficulties in setting up, removing and resetting up a wellpoint system by providing a flexible wellpoint header having attached couplings for wellpoint assemblies and means for storing the pipe on a reel and for aligning the pipe for the attachment of the wellpoint assemblies.

SUMMARY OF THE INVENTION

A well point assembly is provided having an elongated flexible header pipe with a plurality of coupling joints attached thereto for attaching wellpoint assemblies. A flexible header pipe reel stores the flexible header pipe when not in use and allows the header pipe to be reeled off and positioned around an excavation site. Flexible header pipe coupling joints are provided with hat or saddle plugs for sealing those coupling joints not used in the system. Means are provided to align the flexible header pipe during installation to align the coupling joints in the header pipe in a predetermined position for attaching the wellpoint assembly connecting pipe. A method of installing a wellpoint system includes the steps of unreeling a flexible header pipe from a reel, laying the flexible header pipe being unreeled in a pattern around an excavation site for installing a wellpoint system, aligning the flexible header pipe for attaching wellpoint assemblies, removing the coupling plugs from the wellpoint coupling members in the flexible header pipe, and attaching the wellpoint assembly connecting lines. The flexible header pipe will of course have to be connected to a dewatering pump and the wellpoints will have to be placed in the earth around the excavation connected to a swing joint which which connects to the flexible header pipe.

BRIEF DESCRIPTION OF THE DRAWINGS

Other objects, features and advantages of the present invention will be apparent from the written description and the drawings in which.

DESCRIPTION OF THE PREFERRED EMBODIMENT

Figure 1:
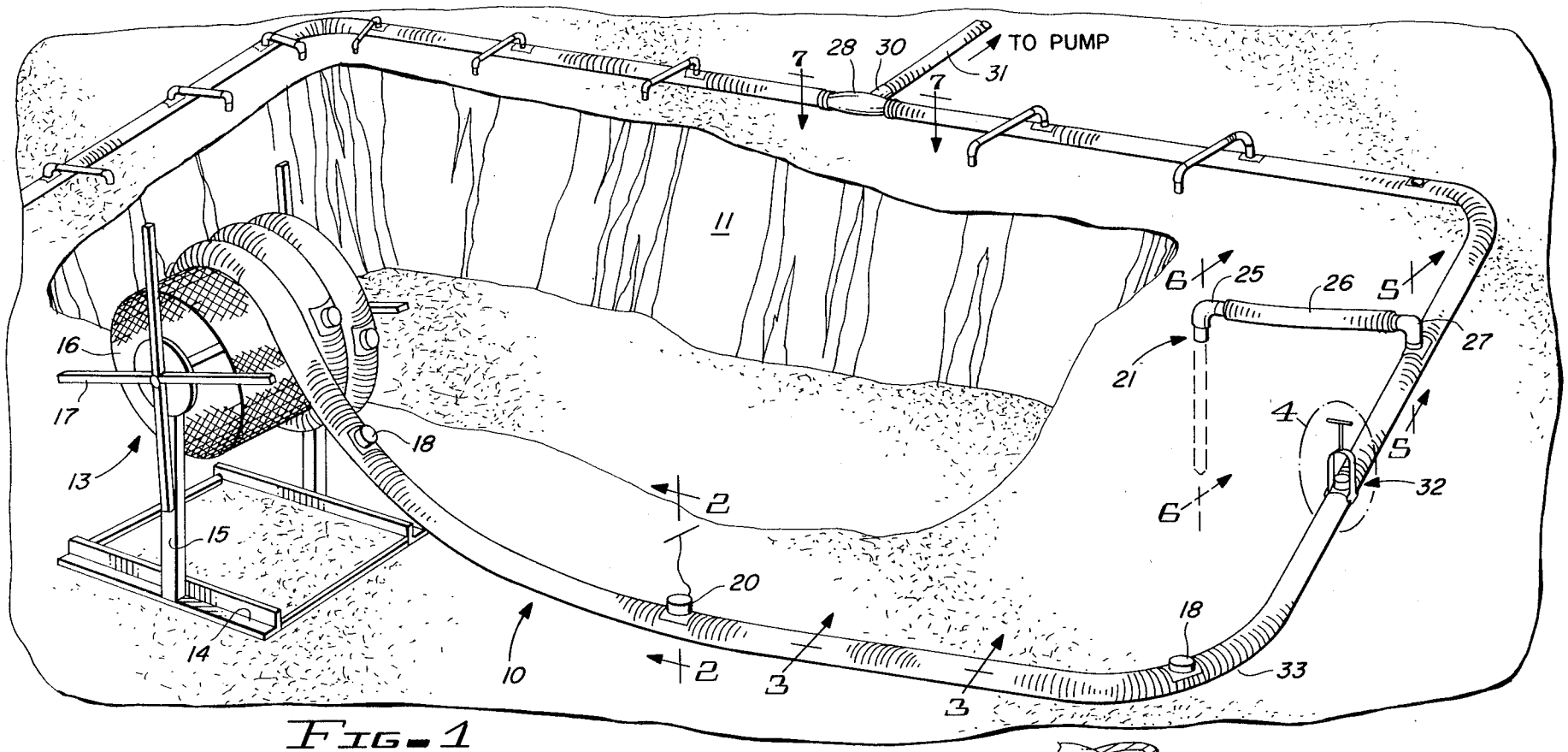
FIG. 1 shows a perspective view of a wellpoint assembly positioned around an excavation site.

Referring to the drawings, especially to FIG. 1, a well point system 10 is placed around an excavation site 11 and includes a flexible header pipe 12 which may be a transparent polymer pipe which is being unrolled from a large reel 13. The reel 13 has a base 14 with supporting frame members 15 with a reel portion 16 having handles 17 and a portion of the flexible header pipe 12 wrapped around the reel portion 16. The flexible header pipe 12 has a plurality of saddle joints or couplings 18 having removal saddle plugs 20 therein. The flexible header pipe 12 extends around the excavation site 11 and has a plurality of well point assemblies 21 attached thereto. The well point assemblies include the wellpoint 22, a riser pipe 23, a well head 24 connected into an elbow connector 25 which is connected to a short flexible swing line or pipe 26 which in turn is connected to an elbow coupling 27 which connects pipe 26 to the flexible header pipe 12. Having the flexible header pipe 12 allows the entire wellpoint system of FIG. 1 to be laid out with one continuous length of pipe having any number of well point assemblies 21 attached thereto. It also allows any particular wellpoint assembly coupling 18 to remain unused and plugged with a saddle plug 20. If the excavation site 11 is too large for the flexible header pipe 12 which can be made of any length desired, the length may be extended by the use of a T-joint 28 to add an additional flexible header pipe to the existing pipe and at the same time provide an additional coupling 30 for additional wellpoint assembly 31. The coupling joints 18 must be aligned for the attachment of the elbows 27 in that the flexible continuous length header couplings may end up positioned in a great variety of positions. This is solved by the flexible header aligning tool 32 which is pushed into the earth over the flexible header pipe adjacent a saddle joint 18 to lock the saddle joint with its center axis extending vertically for the attachment of the elbow 27. Header alignment tool 32 may be attached in a plurality of positions especially around the sharp curve 33 in the layout pattern for the wellpoint system so that all of the joints 18 are aligned in the proper position for attaching the elbow connectors 27 for connecting the well point assemblies 21. Once the wellpoint assembly is connected, the header alignment tools 32 can be removed if desired since the flexible header pipe 12 will be held in position by the couplings to the wellpoint assemblies.

Figure 2:
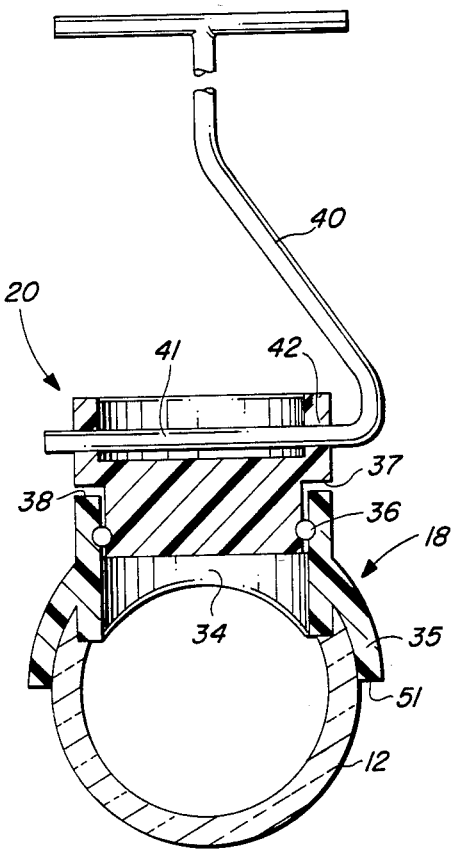
FIG. 2 is a sectional view taken on the line 2—2 of FIG. 1.

Referring to FIG. 2, the flexible header pipe 12 can be shown having the saddle joint 18 connected thereto which has an annular opening 34 with arcuate side arms 35 extending on either side thereof. Annular openings 34 extends through an opening in the header pipe 12 and allows the saddle plug 20 to be attached therein. The saddle plug can be pressure fitted against an O-ring seal 36 and may have an annular sealing ledge 37 to fit against the annular edge 38 of the saddle connector 18. Saddle plug 20 may have a handle 40 with a horizontally extending portion 41 passing through a pair of apertures 42 in the saddle plug 20 for lifting the saddle plug out of the saddle coupling 18.

Figure 3:
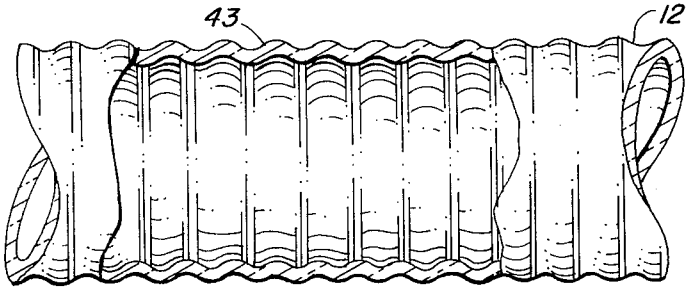
FIG. 3 is a sectional view taken on the line 3—3 of FIG. 1.
Figure 4:
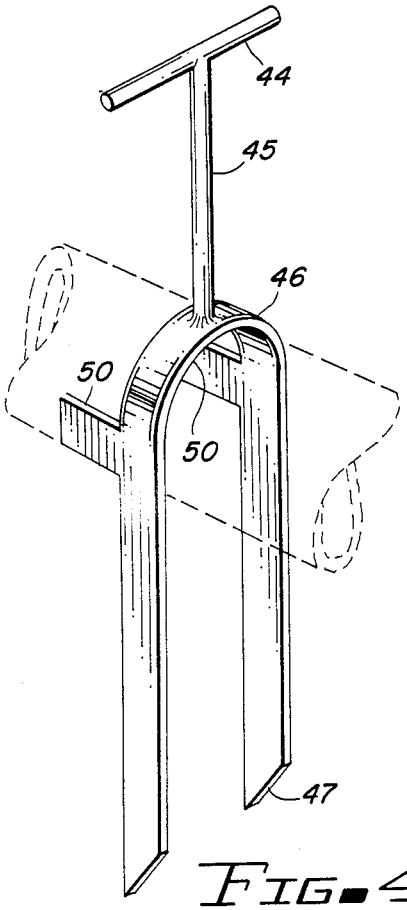
FIG. 4 is a sectional view taken on the circle 4 of FIG. 1.

FIG. 3 shows the flexible header pipe 12 which may be made of a transparent material and may have corrugations 43 formed therein. In FIG. 4 the aligning tool 32 is shown having a handle 44 attached to an elongated shaft 45 attached to a bifurcated pair of prongs 46, each having a pointed tine 47 and formed with arcuate top portion. The tines 47 and the arcuate portion are designed to fit exactly the diameter of the flexible header 12. A pair of alignment arms 50 extend from the edges of the pair of tines or prongs 47 and may slide under the edges 51 of the saddle joint 20 arcuate sides 35 to lock the saddle joint 20 in a vertically extending position for attaching the elbow 27.

Figure 5:
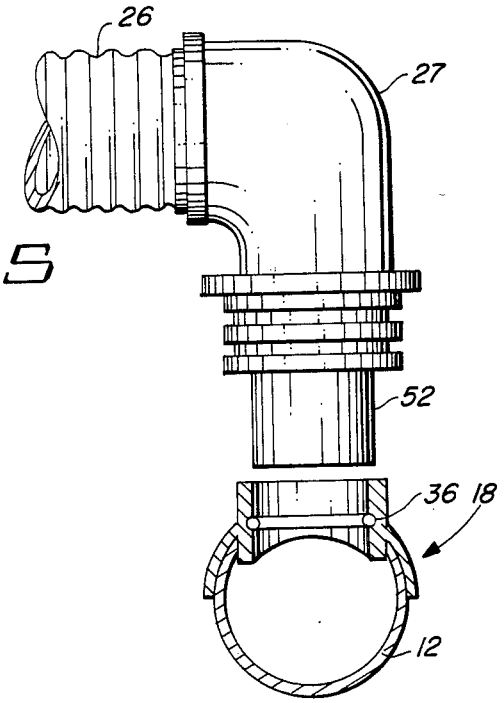
FIG. 5 is a sectional view taken on the line 5—5 of FIG. 1.

In FIG. 5, the elbow connecting joint 27 is shown connecting to a flexible swing line 26 which connects to the wellpoint and wellpoint riser. The pipe 26 may be connected to the elbow 27 in a fixed manner or may be clamped while the coupling portion 52 of the elbow 27 is a smooth sleeve adapted to fit into the opening 34 of the saddle joint 18 against the O-ring seal 36. This allows the entire elbow coupling 27 to be rotated without losing its vacuum or pressure for positioning the well point assemblies in different positions relative to the saddle joint 18. This combined with the flexible line 26 allows a wide variation in the postioning of the wellpoint heads.

Figure 6:
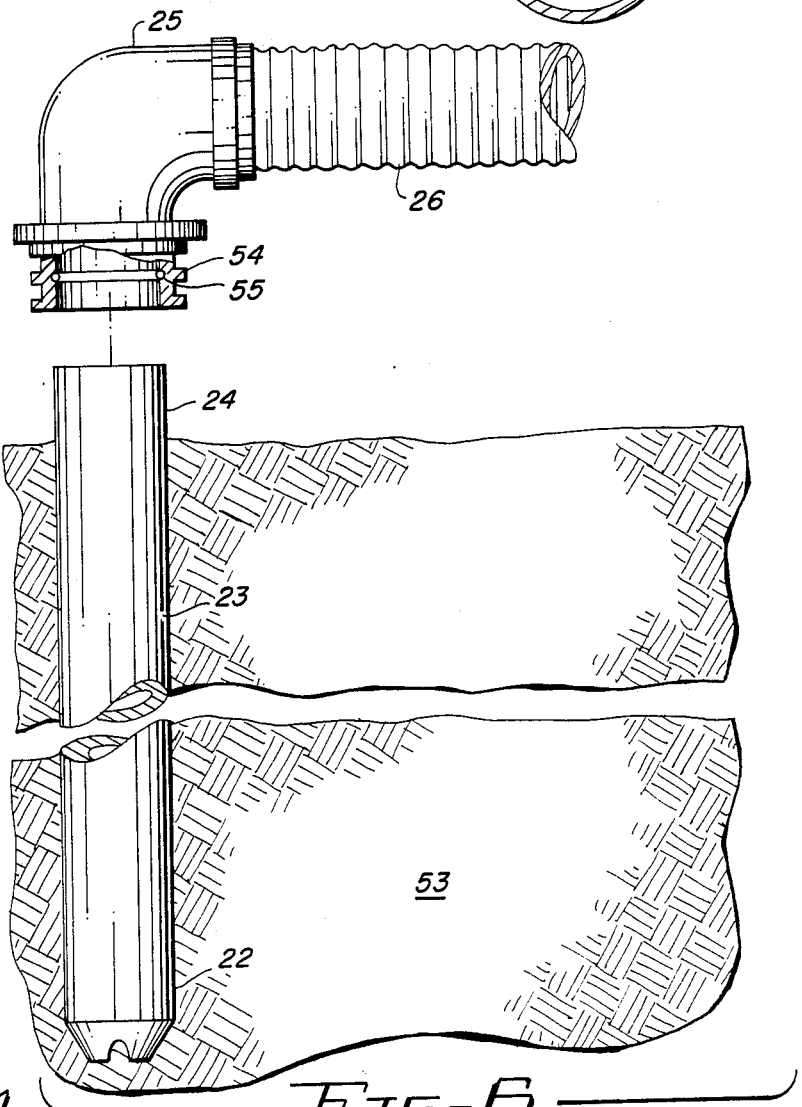
FIG. 6 is a sectional view taken on the line 6—6 of FIG. 1.

FIG. 6 shows the wellpoint head 22 placed in the earth 53 adjacent the excavation 11 and having a riser pipe 23 with a well top or well head 24 for connecting the other end of the pipe 26 with a second elbow joint 25. The pipe 26 is connected to the pipe 25 in a permanent fashion or may be clamped or attached in any manner desired and has a removable coupling portion 54 having an O-ring seal 55 therein for sliding over the well head 24. This seal also allows the elbow 25 to be rotated to allow a wide variety of positioning of the wellpoint assembly and well point head.

Figure 7:
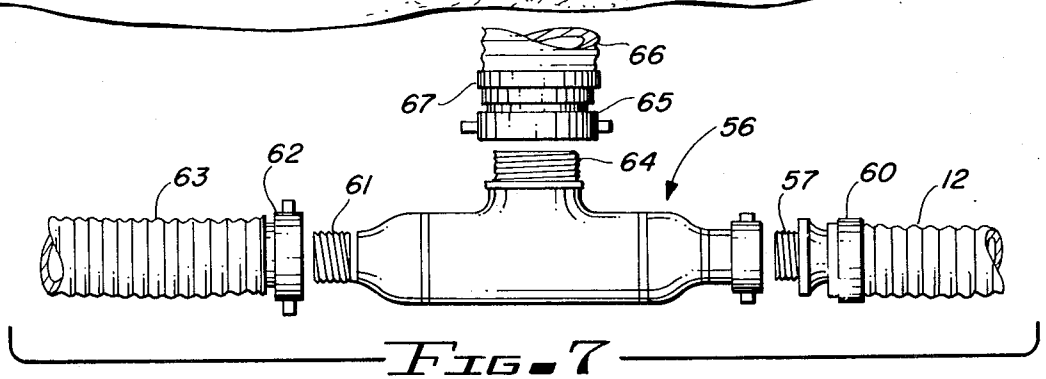
FIG. 7 is a sectional view taken on the line 7—7 of FIG. 1.

Turning to FIG. 7, the flexible header 12 of the present invention is shown connected to a T-coupling 56 with a threaded connector 57 connecting into an internal threaded connector in the T-coupling 56. The header 12 is connected with a clamp 60 the threaded coupling 57. A similar threaded coupling 62 is connected to the other side of the T-coupling 56 for connecting to a threaded coupling 62 for connecting to a second flexible header pipe 63 for extending the overall length of the flexible header 12. The T-portion of the joint 56 has an additional threaded coupling 64 connectable to a threaded coupling member 65 connected to a flexible pipe 66 with a clamp 67. The pipe 66 can be an additional flexible header pipe for providing an additional excavation with wellpoint assemblies.

It should be clear at this point that a wellpoint system has been shown which can be easily and quickly installed around an excavation site and can be quickly and easily removed from one site to another and which takes a smaller amount of storage space when not in use and when transported to an excavation site. The present invention, however, also contemplates the method of installing a wellpoint system in accordance with the apparatus illustrated and includes the steps of reeling the flexible header pipe 12 onto a large custom reel 13 for transporting to an excavation site 11, unreeling the flexible header pipe 12 from the reel 13, then laying the flexible header pipe in a pattern such as shown in FIG. 1. The flexible header pipe may be transparent for observing the flow of fluid and for locating air bubbles or leaks to keep the system flowing smoothly. Once the flexible header pipe 12 is aligned around an excavation site, the coupling joints in the header pipe 12 are aligned with the header alignment tool 32 to position the couplings 18 in a predetermined position for receiving coupling elbows 27 for the well point assemblies. The well point assembly couplings not being used may have saddle plugs 20 placed in those couplings 18 not being connected to a wellpoint assembly 21.

Finally, the process includes the removal of the coupling elbows 27, the replacement of the saddle plugs 20 if desired, and the reeling of the flexible header pipe 12 back onto the reel 13 which may be loaded on the back of a pickup truck or the like and moved to a different excavation job. Steps in the process would also include inserting the prongs of the alignment tool 32 into the ground at predetermined positions adjacent couplings 18 and mounting them to hold the couplings 18 in a predetermined position with their openings extending in a vertical direction, then attaching the elbows 27 and removing the tools 32. Finally, the process might include the use of a T-joint for attaching three flexible header lines 12 together for extending the area being dewatered by the wellpoint system. Accordingly, the present invention is not to be considered as limited to the forms shown which are to be illustrative rather than restrictive.

I claim:

1. A wellpoint assembly comprising in combination:
an elongated flexible header pipe;
a plurality of coupling joints attached to said flexible header, each said coupling joint being adapted for attaching a well point assembly;
a flexible header pipe support for supporting said flexible header pipe; and
means to align portions of a continuous flexible header pipe for attaching a plurality of wellpoint assemblies, said means to align portions of said flexible header pipe including an alignment tool for aligning each flexible header coupling joint into a predetermined position for attaching a well point assembly line whereby a wellpoint assembly can be laid out around an excavation site in a wide variety of patterns.

2. The wellpoint assembly in accordance with claim 1, in which each of said plurality of coupling joints is a saddle joint having an opening therein into said flexible header pipe.

3. The well point assembly in accordance with claim 2, including a saddle plug for removably sealing each of said plurality of coupling joints.

4. A well point assembly in accordance with claim 1, in which said flexible header pipe is a transparent corrugated polymer pipe.

5. A well point assembly in accordance with claim 1, in which said flexible header pipe support has a base with the framework attached thereto and a large reel having handles for rotating said flexible header pipe thereonto.

6. A well point assembly in accordance with claim 5, including a T-joint having coupling means for attaching a plurality of flexible header pipes together.

7. A wellpoint assembly comprising in combination:
an elongated flexible header pipe;
a plurality of coupling joints attached to said flexible header, each said coupling joint being adapted for attaching a well point assembly;
a flexible header pipe support for supporting said flexible header pipe; and
means to align portions of a continuous flexible header pipe for attaching a plurality of wellpoint assemblies, said means to align portions of said flexible header pipe including an alignment tool for aligning each flexible header coupling joint into a predetermined position for attaching a well point assembly line, said alignment tool including a pair of bifurcated prongs having a handle attached thereto for extending over said flexible header pipe into the earth and further including at least one aligning member attached thereto for aligning said saddle joint in a predetermined position for attaching a wellpoint assembly connection line, whereby a wellpoint assembly can be laid out around an excavation site in a wide variety of patterns.

8. A well point assembly in accordance with claim 7, in which said alignment tool has a pair of perpendicular extending alignment members extending from said bifurcated prongs.

9. A well point assembly in accordance with claim 8, in which said well point assembly connecting line is a flexible connecting pipe having an elbow joint at one end thereof for rotatably attaching to said flexible heater saddle joint.

10. A method of installing a wellpoint system comprising the steps of:
laying a continuous flexible header pipe in a pattern for installing a wellpoint system, including unreeling said flexible header pipe from a reel prior to laying the flexible header pipe in a pattern for installing a wellpoint system;
aligning a continuous flexible header pipe in a plurality of locations therealong for attaching a plurality of well point assemblies thereto;
removing coupling plugs from wellpoint coupling members in the flexible header pipe; and
attaching wellpoint assemblies to said wellpoint coupling members.

11. A method in accordance with claim 10, in which the step of aligning the flexible header pipe includes inserting a prong tool into the earth over said flexible header pipe to hold said flexible header pipe in a predetermined position for attaching the wellpoint assembly to the flexible header pipe coupling.

12. A method in accordance with claim 11, including the step of removing attached wellpoint assemblies from said flexible header pipe and reeling said flexible header pipe back onto a reel.

13. A method in accordance with claim 12, including the step of attaching a T-joint joining a plurality of flexible header lines together to form a predetermined pattern for well point installation.

14. A method in accordance with claim 13, including the step of removing each alignment tool after aligning a flexible header pipe and attaching a wellpoint assembly connection line.

15. A method in accordance with claim 14, including the step of selecting a transparent flexible header pipe for use in a wellpoint system and attaching a plurality of coupling joints in a predetermined spaced relationship to each other.

* * * * *